US006562170B2

(12) United States Patent
Thomas

(10) Patent No.: US 6,562,170 B2
(45) Date of Patent: May 13, 2003

(54) METHOD OF PRODUCING FILM HAVING A CLOTH-LIKE LOOK AND FEEL

(75) Inventor: Paul Eugene Thomas, Terre Haute, IN (US)

(73) Assignee: Tredegar Film Products Corporation, Richmond, VA (US)

( * ) Notice: Subject to any disclaimer, the term of this patent is extended or adjusted under 35 U.S.C. 154(b) by 67 days.

(21) Appl. No.: 09/778,469

(22) Filed: Feb. 7, 2001

(65) Prior Publication Data

US 2002/0104609 A1 Aug. 8, 2002

(51) Int. Cl.[7] ..... B32B 27/12; B32B 31/30

(52) U.S. Cl. ..... 156/167; 156/179; 156/244.18; 156/244.19; 156/244.21; 156/244.27; 156/253; 156/285

(58) Field of Search ..... 156/167, 179, 156/244.11, 244.18, 244.19, 244.21, 244.27, 250, 252, 253, 285

(56) References Cited

U.S. PATENT DOCUMENTS

| | | | | |
|---|---|---|---|---|
| 2,811,769 | A | 11/1957 | Craig | 28/72.3 |
| 4,100,324 | A | 7/1978 | Anderson et al. | |
| 4,144,370 | A | 3/1979 | Bovlton | |
| 4,209,563 | A | 6/1980 | Sisson | |
| 4,426,421 | A | 1/1984 | Nakame et al. | |
| 4,495,133 | A | 1/1985 | Sugihara et al. | |
| 4,591,513 | A | 5/1986 | Suzuki et al. | |
| 4,995,930 | A | 2/1991 | Merz et al. | |
| 5,841,081 | A | 11/1998 | Thompson et al. | 181/286 |
| H1827 | H | 1/2000 | Cooper et al. | |
| 6,417,426 | B1 | 7/2002 | Takai et al. | 604/378 |

FOREIGN PATENT DOCUMENTS

| | | |
|---|---|---|
| EP | 0861 646 A2 | 9/1998 |
| WO | WO 96/26697 | 9/1996 |

OTHER PUBLICATIONS

Copending U.S. application No. 08/850635 filed May 2, 1997 (Based on U.S. 6,242,074 B1).

European Patent Office, Standard Search Report No. RS 106548 for US Application 09/778,469 completed Nov. 15, 2001, pp. 1–3.

*Primary Examiner*—Sam Chuan Yao
(74) *Attorney, Agent, or Firm*—Jenkens & Gilchrist, P.C.

(57) ABSTRACT

A method for producing a film with attached fibrils having a cloth-like look and feel. A flocking or metering device is provided for dispensing a layer of the fibrils. The fibrils are next delivered onto a moving vacuum belt, which has a porous surface for drawing the layer of fibrils thereto. After dispersion, the fibril layer is transported and held by the vacuum conveyor belt to a position under a slot cast extrusion die, where a lower temperature melt polymer is released. Upon release, the lower temperature melt polymer and fibril layer fuse and combine to interlock to create a composite temporary web. In one embodiment, the fibril layer and lower temperature melt polymer are delivered at a first nip point between a pair of nip rollers to create the composite temporary web. The composite temporary web may next be collected on collection rolls, or combined with a higher temperature melt polymer under a second slot cast extrusion die to form a permanent film with fibrils. During combination with the higher temperature melt polymer, the lower temperature melt polymer of the composite temporary web melts and fuses into the higher temperature melt polymer and is drawn between a nip roll and a perforated vacuum forming screen having a pressure differential at a second nip point to harden and create apertures in the film and allow the fibril layer to follow the contours of the film, while the openings of the apertures remain free from fibrils.

7 Claims, 3 Drawing Sheets

METHOD OF PRODUCING FILM HAVING A CLOTH-LIKE LOOK AND FEEL

TECHNICAL FIELD

The present invention relates in general to a method for affixing individual fibrils to a film, and in particular but not by way of limitation, to a method for affixing individual fibrils to a three-dimensional formed and apertured film by causing a low melt point web to intermingle with and/or captivate individual fibrils of essentially non-melting material, wherein the fibrils become partially embedded and/or entangled in the low melting point web to form a composite temporary web of both a low melt point polymer and the affixed fibrils, and subsequently introducing the composite temporary web into a second molten web of higher melt temperature, thereby causing the temporary web to melt into the contacting face of the second molten web and subsequently in preferred embodiments aperturing and forming the permanent film.

BACKGROUND OF THE INVENTION

Absorbent articles such as sanitary napkins, incontinent devices, diapers, wound dressings and other products are well known. These articles absorb liquid and retain the liquid within a core. The interior or topsheet of the absorbent article is made of a flexible plastic film material. A negative characteristic of the flexible plastic film material is a glossy or "plastic" look and sticky tactile feel. It is desirable to produce absorbent devices which have a cloth-like look and feel to a user's skin.

Many types of films have been proposed to overcome these tactile problems, such as the film disclosed in U.S. Pat. No. 4,995,930, which depicts a system for laminating a perforated plastic film and a fibrous web material, wherein a pneumatic vacuum is used to perforate the film when it is in a thermoplastic condition. However, the prior art relies on the existence of a web, and does not teach the application of individual fibrils that are not in a web structure. In commonly-owned U.S. application Ser. No. 08/850,635, the lack of a web is compensated for by the presence of a continuous belt, which carries a controlled amount of individual fibrils onto the molten web. The resulting web is subsequently formed and apertured with the composite component of the fibrils affixed to the contour of the user-side surface.

U.S. application Ser. No. 08/850,635 does not teach that fibrils are bound together to form a web, therefore the film disclosed therein lacks the integrity and transport properties of a web; hence, it is taught that they are conveyed by a belt. Further, because the conveying belt or drum of U.S. application Ser. No. 08/850,635 is cumbersome and difficult to maintain in the precise operating parameters required, inventive means must be incorporated to deliver the fibrils to the film-forming step in order to create the composite structure of a film with a fibrilized surface that follows the contour of the funnel-like cells, rendering them unobstructed.

The method of this invention eliminates the need for the carrier/conveyor belt by providing a composite temporary web with web integrity that can be transported directly into the lamination/forming process. Once the temporary web is in contact with the molten face of the film forming web, the temporary web melts and fuses, thereby depositing and embedding the fibrils thereto.

SUMMARY OF THE INVENTION

In the first embodiment, a flocking or metering device is provided for dispensing a controlled amount of individual fibrils. The fibrils are delivered onto a moving conveyor belt, which in certain embodiments may comprise a vacuum belt having a porous surface for drawing the layer of fibrils thereto. The unbonded fibrils are individual or substantially individual during dispersion from the flocking device, and remain unbonded after dispersion. Next, the fibril layer is transported and held by the vacuum conveyor belt to a position under a slot cast extrusion die, where a low temperature polymer melt is released. Upon release of the low temperature polymer melt, a vacuum pulls the low temperature polymer melt onto the surface of the fibril layer with a predetermined amount of pressure. This pressure may be sufficient to cause the fibrils to embed in the contacting surface of the polymer film, especially if tacky polymers are employed such as EVA, EMA, EEA, and others.

If low melt temperature polyethylenes are used, one can then deliver the combined polymer film and fibril layer to a nip point between a pair of nip rollers to cause sufficient pressure to captivate the fibrils and create the composite temporary web. Proximity positioning or very light pressure of the nip rollers is preferable to avoid flattening the fibrils onto the polymer film. In this manner, only a portion of most of the fibrils becomes embedded and affixed to the temporary polymer film. The more substantial portion of the fibrils maintain at least one loose end protruding off the surface of the composite temporary web.

These composite temporary webs may next be spooled or wound into master rolls for further processing at a later time, or processed in-line with subsequent process equipment to be combined with the higher temperature polymer melt under a second slot cast extrusion die for formation of the permanent film. This second in-line option will provide a continuous process mode as opposed to the roll option, which requires a secondary batch process. These options are available for all embodiments described herein.

During the combination with the higher temperature polymer melt, the lower melt temperature portion of the composite temporary web melts and fuses into the higher temperature polymer melt. The resulting permanent film is drawn against a perforated vacuum forming screen having a pressure differential to create funnel-like contours and apertures in the film and allow the fibrils to embed into and follow contours of the permanent film. A majority of aperture openings remain free of fibrils. It is also contemplated within the scope of this invention that these methods can apply to any known film making process. Smooth films and embossed films, as well as the preferred three-dimensional apertured films, can benefit by being enhanced with a surface of soft fibrils.

In a second embodiment, a flocking or metering device is provided to dispense the fibrils. From the device, the fibrils are delivered onto a moving vacuum belt having a porous surface for drawing and holding the fibrils thereto. The unbonded fibrils are individual or substantially individual during dispersion and remain unbonded after dispersion. Next, the fibril layer is transported and held by the vacuum conveyor belt to a position under a nonwoven meltblown extrusion die, which has a plurality of air slots releasing air streams at converging angles. The converging air streams create a turbulent zone for the dispersion of the lower temperature polymer melt, which is released from the extrusion die in fiber-like strands.

The layer of fibrils is next combined with the lower temperature polymer melt on a porous surface of a conveyor belt wheel having an internal vacuum which creates a vacuum zone to form a composite temporary web. While the fibrils are somewhat adhered to but mostly entangled in the lower temperature polymer melt web, the fibrils do not melt or bond by fusing. Nonetheless, the fibrils are captivated in the lower temperature polymer melt to form the composite temporary web.

In a third embodiment of the present invention, a flocking device for dispersing a controlled amount of fibrils is suspended adjacent to a nonwoven meltblown extrusion die. Gravity and venturi forces cause the controlled amount of fibrils dispersed over a controlled slot-like area, as determined by the exit slot of the flocking/metering device, to fall and be pulled into the path of converging air streams of the nonwoven meltblown process. Then, being caught in the converging air streams, the fibrils become somewhat adhered to and mostly entangled in and thus captivated during the forming of the lower temperature polymer melt as it is drawn down to the vacuum belt, which flattens and forms the lower temperature polymer melt. This process creates the composite temporary web.

To summarize, the first embodiment extrudes a molten polymer film on a surface of a layer of fibrils combined with a light pressure to embed a portion of the fibrils into the polymer film surface, thereby captivating the fibril layer. The second and third embodiments introduce fibrils into a nonwoven meltblown web at various stages of the formation of the temporary composite web. A meltblown process extrudes multiple strands of hot polymer into converging air streams that create a turbulent zone. The turbulence causes the strands to 'dance' and entangle as a vacuum belt pulls the strands to the belt surface. As the strands strike the vacuum belt, they remain in a molten state to thereby fuse and bond at the interstices of the randomly dispersed fibers.

The second embodiment introduces the layer of fibrils onto the vacuum belt such that the nonwoven meltblown web lands on top of the layer of fibrils and partially adheres to, but mostly entangles, the upper ends of the fibrils to captivate the fibrils.

The third embodiment introduces the fibrils into the turbulent air stream formed in the nonwoven meltblown process wherein the fibrils become entangled and captivated.

In all embodiments, the material with the highest melt point stability is the fibril, whose temperature parameters are controlled to maintain the fibril softness and integrity. The material with the lowest melt point stability is the polymer used to form the temporary web. The material of the permanent film has a melt point in between, such that the permanent film melts and fuses the temporary film or web onto its contacting surface, thereby leaving the fibrils deposited and embedded thereto with most of the fibrils maintaining at least one loose end.

DETAILED DESCRIPTION

Figure 1:
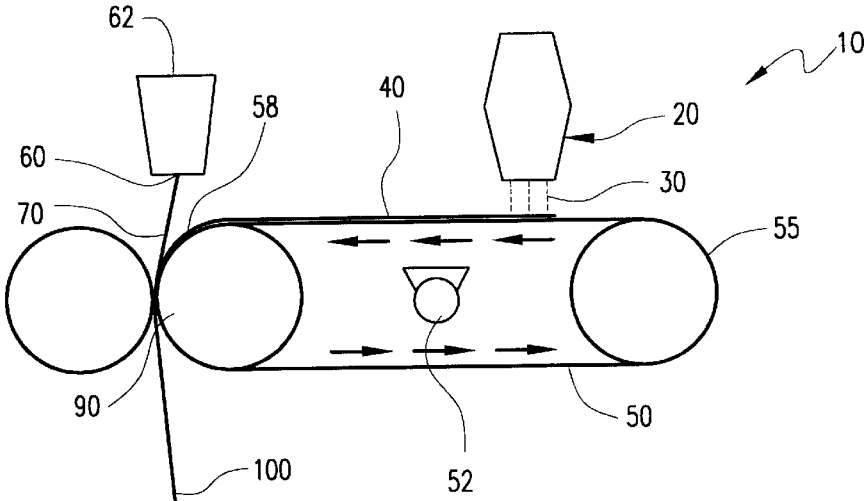
FIG. 1 is a side view of a film forming system, including formation of a temporary composite web, according to the principles of the present invention.
Figure 1A:
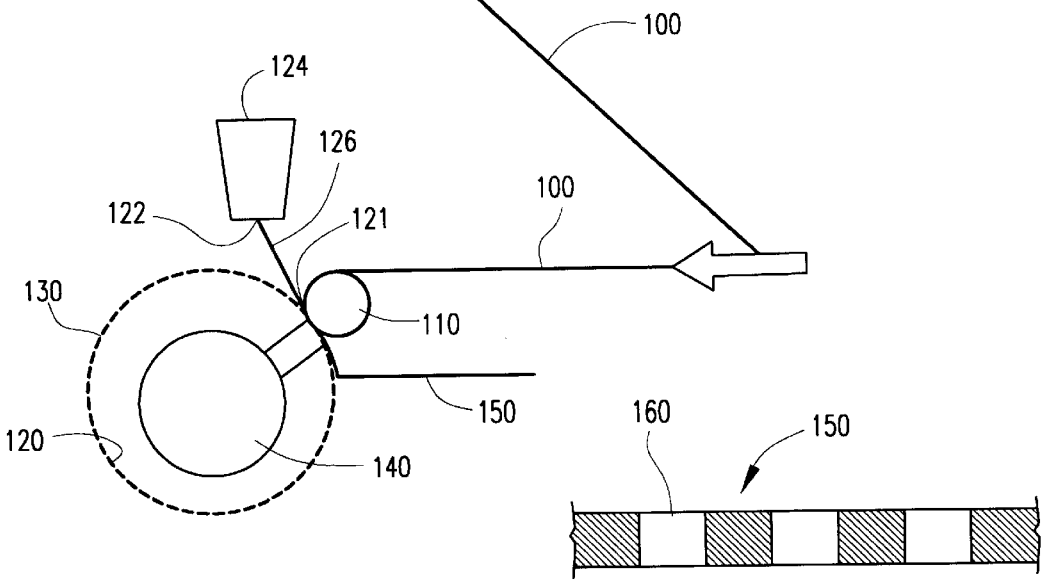
FIG. 1A is a cross-sectional view of an apertured film formed by the system of FIG. 1.

Referring first to FIG. 1, there is shown a side view of a film forming system 10 according to the principles of the present invention. A metering or flocking device 20 distributes individual fibrils 30 to form a layer 40. It is to be understood that the present invention is especially useful in applying fibrous material which comprises loose individual fibrils (i.e., which are not bonded or entangled together to form a web). For purposes of this application, fibrils differ from fibers in that fibrils are microscopically short in length and are typically created by chopping fibers into the micro-scale length of fibrils. Fibrils are essentially individual and are not bonded to each other by adhesives, melt-fusing, pressure-fusing, intentional permanent entanglement, or other means. However, if several random fibrils become somewhat entwined together, they can be separated from each other with minuscule force and without breaking, distorting or otherwise changing their original integrity. Conversely, a fiber is a very long strand amongst thousands of other long strands combined and bonded together to form a web-most commonly known as a nonwoven web. Spunbonded, melt-blown, carded, spunlaced, and other nonwoven webs are commonly known and would be appropriate material for use in the lamination art. Woven webs are made of woven threads, whereby the threads are made by twisting thousands of long fibers together.

The fibrils 30 ideally will have a predetermined micro-scale length such that the possibility is negligible for a single fibril or groups of entwined fibrils to bridge across the opening of a cell of a three-dimensionally formed and apertured film. This accounts for the soft feel of the fibrilized surface while avoiding any significant obstruction to the intended fluid flow through a topsheet's funnel-like formed and apertured cells or openings.

For a common 25 mesh pattern of cells for three-dimensionally formed and apertured topsheet films, the ideal fibril length will be determined as follows:

1. Since 'mesh' is the number of formed cells aligned in a one inch length, the distance from rim to rim of a single cell is about 40 mils;
2. For a fibril to have a length which could bridge entirely across the formed cell, it would require a length of at least about 40 mils;
3. To have an average fibril micro-length with negligible probability for bridging entirely across the formed cell, a length of less than about 40 mils will suffice;
4. No fiber chopping method exists which delivers a consistent micro-length to every fibril; hence, if the average micro-length of the fibril is set somewhat below the micro-length required to bridge across the cell, then the cell's openings will be caused to remain unobstructed due to the absence of fibril bridging.

Referring still to FIG. 1, the layer 40 of fibrils 30 is formed on and adheres to a conveyor belt 50 at first end 55 of the conveyor belt 50. In a preferred embodiment, the conveyor belt 50 may comprise a porous medium so a vacuum 52 may cause suction therethrough. The conveyor belt 50 may be made of woven cloth, woven metallic wires, woven polymeric strands, nickel deposited screens, etch screens and the like.

The layer 40 of fibrils 30 is held on the surface of the conveyor belt 50 by suction of the vacuum 52 and is transported along the vacuum conveyor belt 50 to a second end 58 of the conveyor belt 50, where an extrusion slot die 60 of a first extruder 62 releases lower temperature polymer melt 70. The lower temperature polymer melt 70 preferably is a polymer web. The polymer web is comprised of a polymer, including but not limited to polyethylene, polypropylene, EVA, EMA and copolymers thereof. Polyethylene is a preferred component of the polymer web. The lower temperature polymer melt 70 is pulled down by suction from within the vacuum conveyor belt 50 into contact on the layer 40 of fibrils 30. System parameters are controlled, as determined by experimentation, such that most of the fibrils 30 become imbedded and locked into the lower temperature polymer melt 70. A pair of light pressure nip rollers 90 compresses the lower temperature polymer melt 70 and a layer 40 of fibrils 30 to form a composite temporary web 100, which then cools by natural convective losses of heat or by assisted cooling.

The composite temporary web 100 may be collected onto a take-up roll, or next delivered in-line between a second nip roller 110 and a forming screen 120 at a nip point 121. At the nip point 121, the composite temporary web 100 is moved underneath a second extrusion slot die 122 of a second extruder 124, where a higher temperature polymer melt 126 is released. The higher temperature polymer melt 126 is combined in a semi-molten state with the composite temporary web 100 and is drawn between the second nip roller 110 and forming screen 120. Perforations 130 in the forming screen 120 allow suction from a second vacuum 140 within the forming screen 120 to draw the composite temporary web 100 through the perforations 130 and create apertures 160 on the resulting permanent film 150. The film 150 is cooled by ambient air and the vacuum 140, but also may be cooled by other available alternatives.

There are three basic components that are desirable for practicing this method: the fibrils 30; the lower temperature polymer melt 70 used to form the composite temporary web 100 which captivates the fibrils; and the higher temperature polymer melt 126 used to form the final permanent film 150. The fibrils 30 are preferably composed of material having the highest melting point. Fibrils 30 can be derived from natural fibers, such as cotton, cellulosics from pulp, animal hair, or synthetic fibers from polyethylene, polypropylene, nylon, rayon and other materials. The lower temperature melt polymer 70 must be comprised of the lowest melting point material. Finally, the higher temperature melt polymer 126 used to form the permanent film 150 must have a melting point above the temporary web's melting point, yet below the fibril's melting point. Melting point separation of at least 10° F. and preferably, around 20° F. has been shown to be successful. A greater separation is of course desirable.

Because the selection of fibrils 30 prevents the fibrils 30 from melting or distorting by the thermal load of the other melt polymers 70, 126, the composite temporary web 100 will effectively 'disappear' into the face of the higher temperature melt polymer 126 during formation of the permanent film 150 while maintaining fibril integrity. It is therefore necessary to select a higher temperature melt polymer 126 that has a melting temperature above the melting point of the composite temporary web 100, yet below the distortion temperature of the fibrils 30.

To best meet the thermal requirements, the fibrils 30 are preferably composed of natural fibers. Natural fibers do not typically 'melt' but rather burn, and then only at extreme high temperatures—usually about two to three times the thermal load of extrusion temperatures used in the film forming system 10. However, polymer fibrils are contemplated within the scope of this method. Nylon, rayon, polyethylene and polypropylene polymers exist with sufficiently high melting points for the purposes of this methodology.

The lower temperature polymer melt 70 is thin, preferably in the range of 0.1–0.5 mils. The fibrils 30 can vary in length, diameter, polymer type, and cross sectional shape. These parameters are decided via experimentation against targets of fluid acquisition, aesthetics and softness. Once defined and set, the metering device 20 is calibrated and loaded to deliver the correct "controlled" layer 40 of individual fibrils 30 onto a moving conveyor belt 50.

Upon contact of the higher temperature polymer melt 126 and the ambient temperature composite temporary web 100, the composite temporary web 100 melts and fuses into the mass of the higher temperature polymer melt 126. The composite temporary web 100 then loses its own definition and integrity, and will move and behave as an incorporated part of the higher temperature polymer melt 126. The resulting film 150 has the individual fibril layer 40 which follows the contour of the reshaping caused by the second nip roller 110, forming screen 120, perforations 130, and vacuum 140 to result in a film 150 with a coating of individual fibrils 30. It is important to note that after formation of the film 150, a majority of the fibrils 30 do not block the apertures 160 that form in the film 150.

Figures 2, 2A:
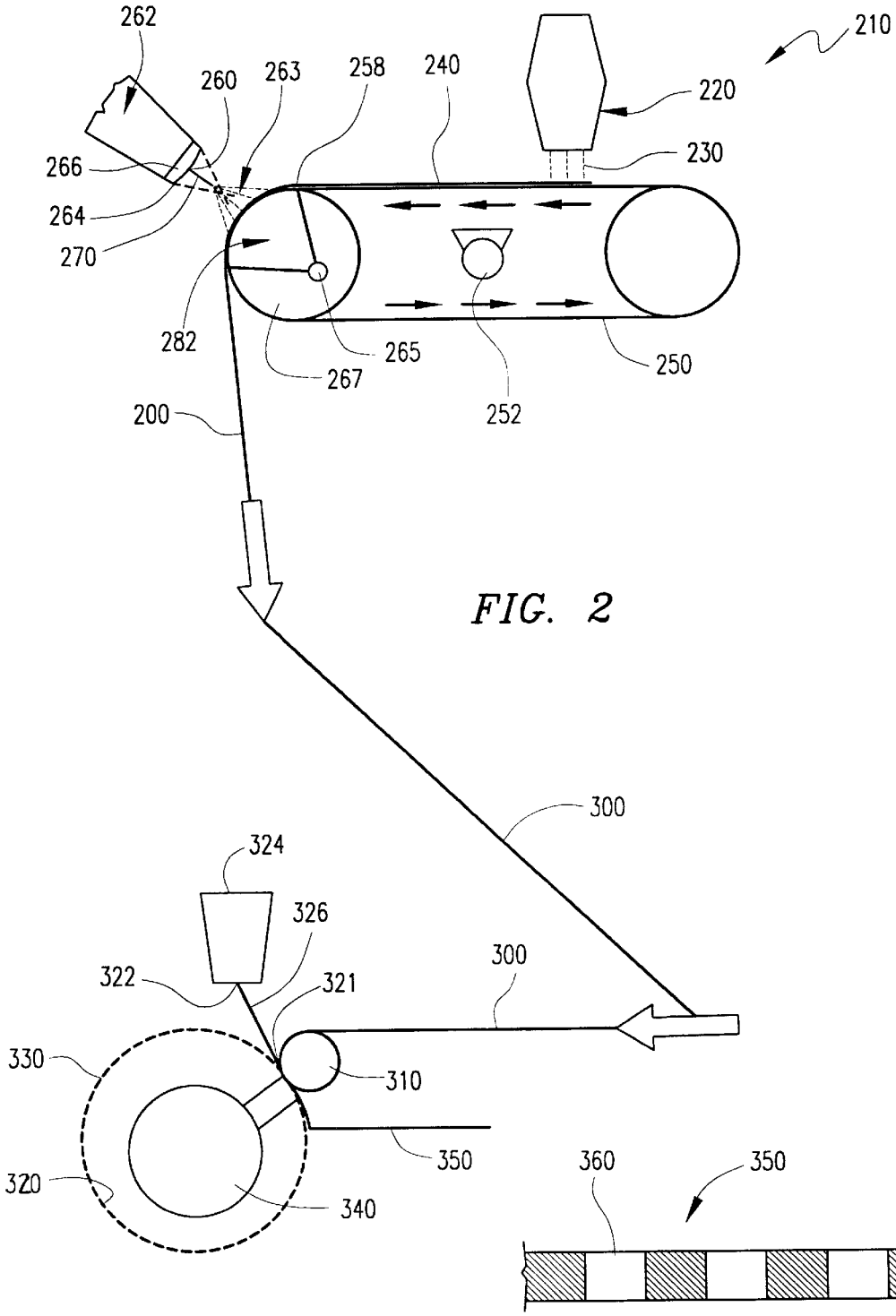
FIG. 2 is a side view of an alternate film forming system, including formation of a temporary composite web, according to the principles of the present invention.
FIG. 2A is a cross-sectional view of an apertured film formed by the system of FIG. 2.

Referring now to FIG. 2, there is shown a side view of an alternate film forming system 210 according to the principles of the present invention. A metering or flocking device 220 distributes individual fibrils 230 to form a layer 240 of fibrils 230 on a conveyor belt 250. In this embodiment, it is preferable the conveyor belt 250 is made of a porous medium so suction from a vacuum 252 may be applied therethrough. The conveyor belt 250 may be made of woven cloth, woven metallic wires, woven polymeric strands, nickel deposited screens, etch screens and the like. Fibril selection and thermal requirements are made similar to that described for the previous embodiments.

The porous conveyor belt 250 serves two purposes: first, it aids in the formation of the composite temporary web 300; and second, it holds the delivered layer 240 of fibrils 230 in place while the lower temperature nonwoven melt polymer strands 270 is being delivered. As the lower temperature nonwoven melt polymer strands 270 lands on the fibril layer 240 in the suction zone 282, the lower temperature nonwoven melt polymer strands 270 partially sticks to the layer 240 of fibrils 230 by melt-adhesion. More so, the semi-molten lower temperature nonwoven melt polymer strands 270 and layer 240 of fibrils 230 will entangle and mechanically lock together in the newly combined composite temporary web 300 having intermingled fibrils.

The layer 240 of fibrils 230 is held to the surface and transported along the conveyor belt 250 to a second end 258 at the conveyor belt 250, where extrusion die slot orifices 260 of a nonwoven meltblown extruder 262 releases lower temperature nonwoven melt polymer strands 270. The nonwoven meltblown extruder 262 has a plurality of air slots 264 at opposing sides of nonwoven meltblown die 266 with the extrusion die orifices 260 therebetween. The air slots 264 are positioned at a converging angle such that the air streams from each air slot 264 will intercept and collide to create a turbulence. The lower temperature nonwoven melt polymer strands 270, which are nonwoven polymer melt-blown fibers, extrudes out of the nonwoven extrusion slot orifices 260 in fiber-like strands. The converging air streams from the adjacent air slots 264 collide in a turbulent zone 263 below the exit point of the extrusion die orifices 260. The turbulent zone 263 pushes, elongates and thins the strands of the lower temperature nonwoven melt polymer strands 270. The turbulent zone 263 also simultaneously causes the lower temperature nonwoven melt polymer strands 270 to dance in random disarray. The mass of randomly entangling, dancing, lower temperature nonwoven melt polymer strands 270 is drawn by suction from a second vacuum 265 in a conveyor wheel 267 into a suction zone 282 which pulls the nonwoven meltblown lower temperature nonwoven melt polymer strands 270 onto the porous conveyor belt 250 and conveyor wheel 267. The air streams are heated such that the molten state of the elongating and entangling lower temperature nonwoven melt polymer strands 270 maintains its melting phase. Thereby, when the suction pulls the molten lower temperature nonwoven melt polymer strands 270 down upon itself, the fiber-like strands of the nonwoven meltblown lower temperature nonwoven melt polymer strands 270 fuse and bond while entangling the fibrils 230 to form a composite temporary web 300, which then cools by natural convective losses of heat or by assisted cooling.

The composite temporary web 300 may be collected onto a take-up roll, or next delivered in-line between a nip roller 310 and a forming screen 320 at a nip point 321. At the nip point 321, the composite temporary web 300 is moved underneath a second extrusion slot die 322 ofa second extruder 324, where a higher temperature melt polymer 326 is released. The higher temperature melt polymer 326 is combined in a semi-molten state with the composite temporary web 300 and is drawn between the second nip roller 310 and forming screen 320. Perforations 330 and the forming screen 320 combined with a vacuum 340 in the forming screen 320 create apertures 360 therein to create a film 350. The film 350 is cooled by ambient air and a vacuum 340, but also may be cooled by other available alternatives.

As in process 10, there are three basic components that are desirable for practicing this method: the fibrils 230; the lower temperature nonwoven melt polymer strands 270 used to form the composite temporary web 300 which captivates the fibrils; and the higher temperature melt polymer 326 used to form the final permanent film 350. The fibrils 230 are preferably composed of material having the highest melting point. Fibrils 230 can be derived from natural fibers, such as cotton, cellulosics from pulp, animal hair, or synthetic fibers from polyethylene, polypropylene, nylon, rayon and other materials. The lower temperature nonwoven melt polymer strands 270 must be comprised of the lowest melting point material. Finally, the higher temperature melt polymer 326 used to form the permanent film 350 must have a melting point above the temporary web's melting point, yet below the fibril's melting point. Melting point separation of at least 10° F. and preferably, around 20° F. has been shown to be successful. A greater separation is of course desirable.

Since the selection of fibrils 230 prevents the fibrils 230 from melting or distorting by the thermal load of the other melt polymers 270, 326, the composite temporary web 300 will effectively 'disappear' into the face of the higher temperature melt polymer 326 during formation of the permanent film 350 while maintaining fibril integrity. It is therefore necessary to select a higher temperature melt polymer 326 that has a melting temperature above the melting point of the composite temporary web 300, yet below the distortion temperature of the fibrils 230.

To best meet the thermal requirements, the fibrils 230 are preferably composed of natural fibers. Natural fibers do not typically 'melt' but rather burn, and then only at extreme high temperatures—usually about two to three times the thermal load of extrusion temperatures used in the film forming system 210. However, polymer fibrils are contemplated within the scope of this method. Nylon, rayon, polyethylene and polypropylene polymers exist with sufficiently high melting points for the purposes of this methodology.

The meltblown nonwoven material of the lower temperature nonwoven melt polymer strands 270 will preferably have a range of 2–10 gsm. The fibrils 230 can vary in length, diameter, polymer type, and cross sectional shape. These parameters are decided via experimentation against targets of fluid acquisition, aesthetics and softness. Once defined and set, the metering device 220 is calibrated and loaded to deliver the correct "controlled" layer 240 of individual fibrils 230 onto a moving conveyor belt 250.

Upon contact of the higher temperature melt polymer 326 with the ambient temperature composite temporary web 300, the composite temporary web 300 melts and fuses into the mass of the higher temperature melt polymer 326. The composite temporary web 300 then loses its own definition and integrity, and will move and behave as an incorporated part of the higher temperature melt polymer 326. The resulting film 350 has the individual fiber layer 240 which follows the contour of the reshaping caused by the nip roller 310, forming screen 320, perforations 330, and vacuum 340, to result in a three dimensional apertured film 350 with a coating of individual fibrils. It is important to note that a majority of the apertures 360 resultingly formed in the film 350 remain unblocked by the fibrils 230.

Figures 3, 3A:
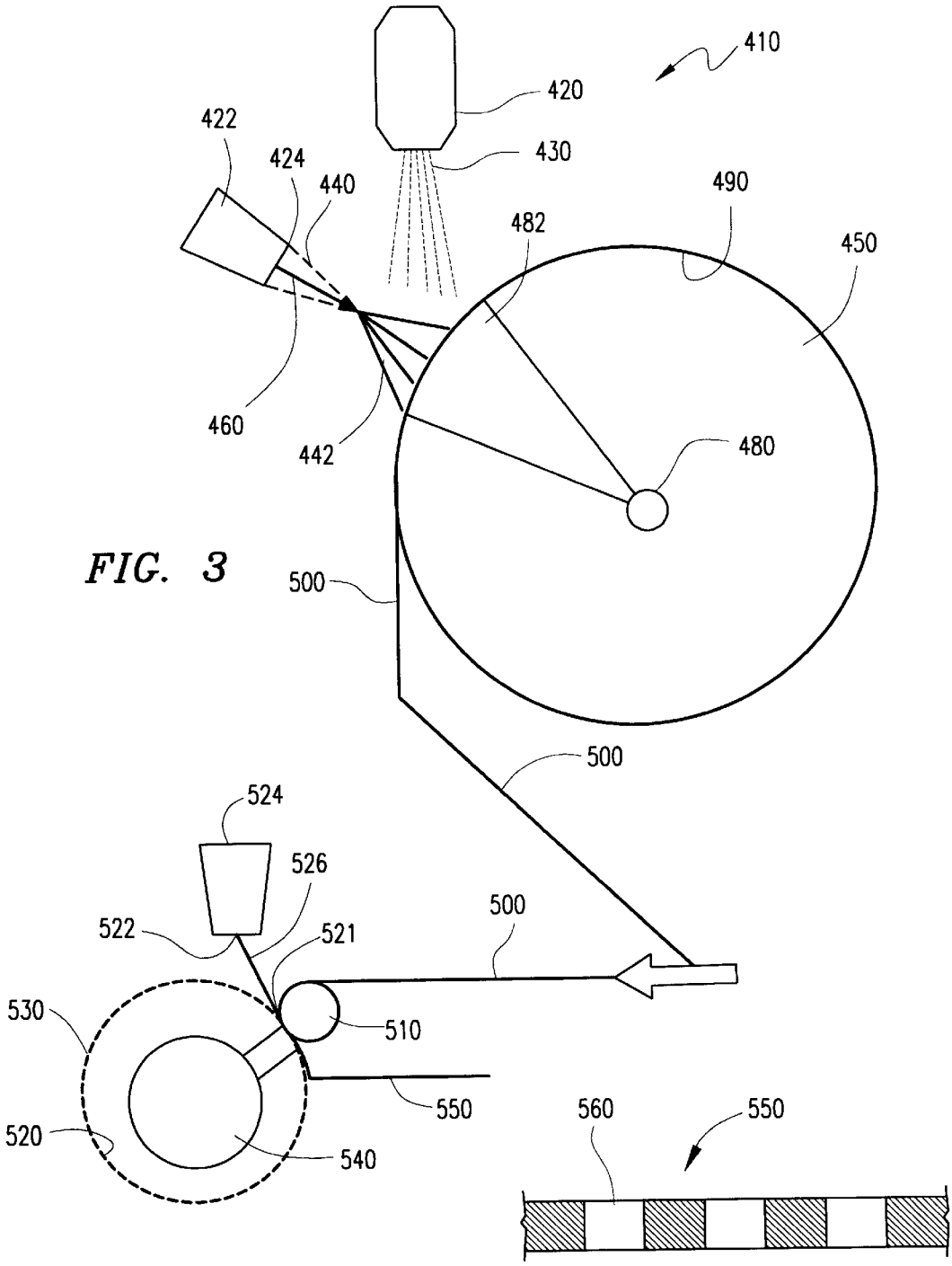
FIG. 3 is a side view of yet another alternate film forming system, including formation of a temporary composite web, according to the principles of the present invention.
FIG. 3A is a cross-sectional view of an apertured film formed by the system of FIG. 3.

Referring now to FIG. 3, there is shown a side view of yet another alternate film forming system 410 according to the principles of the present invention. A fibril metering or flocking device 420 is suspended adjacent to a nonwoven meltblown extrusion die 422 having a plurality of air slots 424. The metering device 420 distributes individual fibrils 430 directly into an air stream 440, which flows from the air slots 424, and onto a rotating drum 450. The air stream 440 forms a turbulent zone 442 and the venturi effect draws the fibrils 430 into the same turbulent zone 442 of lower temperature melt polymer strands 460 released from the die 422. Then, a vacuum 480 pulls the fibrils 430 and polymer 460 together onto a screen 490 of the drum 450 over a vacuum zone 482.

The fibrils 430, being caught in the converging air streams 440 of the turbulent zone 442, become somewhat adhered to, but mostly entangled in one another. The turbulent zone 442 causes the lower temperature melt polymer 460 and fibrils 430 to intermingle in the turbulent air flow, such that the lower temperature melt polymer 460 and fibrils 430 mechanically interlock to form a composite temporary web 500. The composite web 500 hardens upon contact with the surface of the screen 490.

After the composite web 500 has formed, it may be wound onto take-up rolls for collection, or delivered in-line to a nip roller 510 and a forming screen 520 at a nip point 521. At the nip point 521, the composite web 500 is moved underneath a second extrusion slot die 522 of a second extruder 524, where a higher temperature melt polymer 526 is released. The higher temperature melt polymer 526 is combined in a semi-molten state with the composite web 500 and is drawn between the nip roller 510 and forming screen 520. Perforations 530 on the forming screen 520 combined with a vacuum 540 in the forming screen 520 create apertures 560 therein, resulting in a film 550. The film 550 is cooled by ambient air and a vacuum 540, but also may be cooled by other available alternatives.

The fibrils 430 are preferably composed of material having the highest melting point. Fibrils 430 can be derived from natural fibers, such as cotton, cellulosics from pulp, animal hair, or synthetic fibers from polyethylene, polypropylene, nylon, rayon and other materials. The lower temperature melt polymer 460 must be comprised of the lowest melting point material and is preferably a nonwoven. Finally, the higher temperature melt polymer 526 used to form the permanent film 550 must have a melting point above the temporary web's melting point, yet below the melting point of the fibrils 430. Melting point separation of at least 10° F. and preferably, around 20° F. has been shown to be successful. A greater separation is of course desirable.

Because the selection of fibrils 430 prevents the fibrils from melting or distorting by the thermal load of the other melt polymers 460, 526, the composite temporary web 500 will effectively 'disappear' into the face of the higher temperature melt polymer 526 during formation of the permanent film 550 while maintaining fibril integrity. It is therefore necessary to select a higher temperature melt polymer 526 that has a melting temperature above the melting point of the composite temporary web 500, yet below the distortion temperature of the fibrils 430.

To best meet thermal requirements, the fibrils 430 are preferably composed of natural fibers. Natural fibers do not typically 'melt' but rather burn, and then only at extreme high temperatures—usually about two to three times the thermal load of extrusion temperatures used in the film forming system 410. However, polymer fibrils are contemplated within the scope of this method. Nylon, rayon, polyethylene and polypropylene polymers exist with sufficiently high melting points for the purposes of this methodology.

The lower temperature melt polymer 460 is preferably in the range of 2–10 gsm. The fibrils 430 can vary in length, diameter, polymer type, and cross sectional shape. These parameters are decided via experimentation against targets of fluid acquisition, aesthetics and softness. Once defined and set, the metering device 420 is calibrated and loaded to deliver the correct "controlled" amount of individual fibrils 430.

Upon contact of the higher temperature melt 526 with the ambient temperature composite web 500, the composite temporary web 500 melts and fuses into the mass of the higher temperature melt polymer 526. The composite temporary web 500 then loses its own definition and integrity, and will move and behave as an incorporated part of the higher temperature melt polymer 526. The resulting permanent film 550 has the individual fibrils 430 following the contour of the reshaping caused by the nip roller 510, forming screen 520, perforations 530, and vacuum 540, to result in a three dimensional apertured film 550 with a coating of individual fibrils. It is important to note that a majority of resulting apertures 560 that form on the film 550 remain unblocked by fibrils 430.

The benefit in all embodiments of the present invention for affixing fibrils to a low melt temperature film or nonwoven web is to create a composite temporary web. This composite temporary web later melts and fuses into the contacting surface of the molten web of the film forming process, depositing and embedding the fibrils thereto.

It is thus believed that the operation and construction of the present invention will be apparent from the foregoing description of the preferred exemplary embodiments. It will be obvious to a person of ordinary skill in the art that various changes and modifications may be made herein without departing from the spirit and the scope of the invention.

What is claimed is:

1. A method of producing an apertured film with attached fibrils having a cloth-like look and feel, comprising the steps of:

dispensing a controlled layer of fibrils adjacent to an extrusion die having a plurality of air slots, releasing air streams at converging angles from said air slots to create a turbulent zone for the dispersion of a polymer melt having a first melting point;

forming melt blown fibers by releasing said polymer melt having a first melting point from said extrusion die in said turbulent zone in fiber-like strands;

combining said polymer melt having a first melting point with said layer of fibrils to create a composite temporary web;

combining said composite temporary web with a polymer melt having a second melting point to create the permanent film with attached fibrils, wherein said polymer melt having a first melting point in said composite temporary web melts and is absorbed into said polymer melt having a second melting point to form a permanent film with attached fibrils; and drawing the permanent film with attached fibrils between a forming screen having perforations and a vacuum therein and a nip roll to form apertures in the permanent film.

2. The method of claim 1, further comprising the step of hardening and creating apertures in the film wherein said layer of fibrils follow resulting contours in the film, wherein said apertures have openings that remain free of a majority of said layer of fibrils.

3. The method of claim 1, wherein said step of dispensing a controlled layer of fibrils comprises dispensing a controlled layer of individual fibrils.

4. The method of claim 1, wherein said polymer melt having a first melting point and said polymer melt having a second melting point have a melting point separation of at least 10° F.

5. The method of claim 1, wherein said step of combining said polymer melt having a first melting point with said layer of fibrils to create a composite temporary web occurs between a pair of nip rolls.

6. The method of claim 1, wherein said fibrils have a melting point higher than said polymer melt having a first melting point and said polymer melt having a second melting point.

7. The method of claim 1, wherein a majority of said apertures are not blocked by said fibrils.

* * * * *